United States Patent [19]

Bogage

[11] Patent Number: 4,592,702

[45] Date of Patent: Jun. 3, 1986

[54] WATERPROOF FAN

[76] Inventor: Gerald I. Bogage, 12019 SW. 114th Pl., Miami, Fla. 33176

[21] Appl. No.: 525,471

[22] Filed: Aug. 22, 1983

[51] Int. Cl.[4] ..... F04D 29/08

[52] U.S. Cl. ..... 416/247 R; 416/5; 417/424; 310/89

[58] Field of Search ..... 415/121 G; 416/5, 93 R, 416/247 R, 170 C; 417/424; 310/67 R, 89; 98/43 R; 277/212 F

[56] References Cited

U.S. PATENT DOCUMENTS

| | | | |
|---|---|---|---|
| 636,871 | 11/1899 | Wait | 416/5 |
| 2,119,398 | 5/1938 | Morse | 416/5 |
| 2,823,598 | 2/1958 | Jenn | 98/43 R |
| 3,742,595 | 7/1973 | Lykes | 310/89 X |
| 3,760,209 | 9/1973 | Hult | 310/89 X |
| 4,073,598 | 2/1978 | Mizutani et al. | 416/93 R X |

FOREIGN PATENT DOCUMENTS

| | | | |
|---|---|---|---|
| 478417 | 1/1938 | United Kingdom | 416/5 |
| 608569 | 9/1948 | United Kingdom | 416/5 |

OTHER PUBLICATIONS

Awesome ® 60, Leading Edge Inc., Application Data, Dec. 1982.

*Primary Examiner*—Robert E. Garrett
*Assistant Examiner*—Joseph M. Pitko
*Attorney, Agent, or Firm*—Anthony A. O'Brien

[57] ABSTRACT

A waterproof fan is disclosed as including an inverted bell-shaped canopy adapted to be suspended from overhead and having a support rod extending to a second canopy, the top and bottom edges of which are provided with a rubber hood and cowling, respectively; the second canopy covers the top of a motor housing and a fixed shaft connected to the canopy extends into the motor housing on which a plurality of fan blades are attached for rotation therewith.

2 Claims, 4 Drawing Figures

WATERPROOF FAN

BACKGROUND OF THE INVENTION

1. FIELD OF THE INVENTION

The present invention relates to a fan and in particular, to a fan adapted to be suspended from overhead, such as a ceiling fan.

2. DESCRIPTION OF THE PRIOR ART

The prior art contains many examples of electric motors that are provided with various forms of watertight arrangements such as U.S. Pat. No. Re. 20,604 and No. 2,527,707. In addition, the prior art contains many examples of ceiling fans, including a particular fan sold under the U.S. registered trademark AWESOME by Leading Edge, Inc. of Miami, Florida. The AWESOME fan includes an electric motor having a rotor fixed to a motor housing which rotates as a unit with fan blades fastened to the motor housing; an upper and lower canopy are mounted on a support rod which also carries a yoke with electric motor controls and a shaft thereon, which shaft has its other end fixed in the motor housing. None of the known prior art fans provide any waterproofing protection for the fan motor and its controls.

OBJECTS OF THE INVENTION

An object of the present invention is to construct a suspended fan with a waterproofing arrangement.

The present invention has another object in that the canopy covering the electric controls and motor of a fan is made watertight at its top and bottom portions.

It is another object of the present invention to divert water away from the electric motor of a suspended fan.

This invention has a further object in that the motor housing of a suspended fan is provided with a leak plug permitting condensation to drip out of the housing.

It is still a further object of the present invention to construct a rubber cowling for the bottom of a suspended fan canopy with a U-shaped seating arrangement and with a depending water diverting skirt.

SUMMARY OF THE INVENTION

The present invention is summarized in that a fan includes a mount having a support rod and being adapted to support the fan in a suspended manner, an electric motor adapted to rotate the fan and electric control means therefor, a housing for the electric motor, a canopy covering said electric controls and having a top portion secured to the support rod and a bottom portion disposed adjacent the housing, a waterproof hood adapted to be secured to the support rod and covering the top portion of the canopy to inhibit water from entering therein, a waterproof cowling for the bottom portion of the canopy having a first part secured to the bottom portion to inhibit water from entering therein and having a second part projecting toward the housing to divert water away therefrom.

BRIEF DESCRIPTION OF THE DRAWINGS

Many other advantages and objects of the present invention will become apparent from the following description taken in conjunction with the accompanying drawings.

DESCRIPTION OF THE PREFERRED EMBODIMENTS

Figure 1:
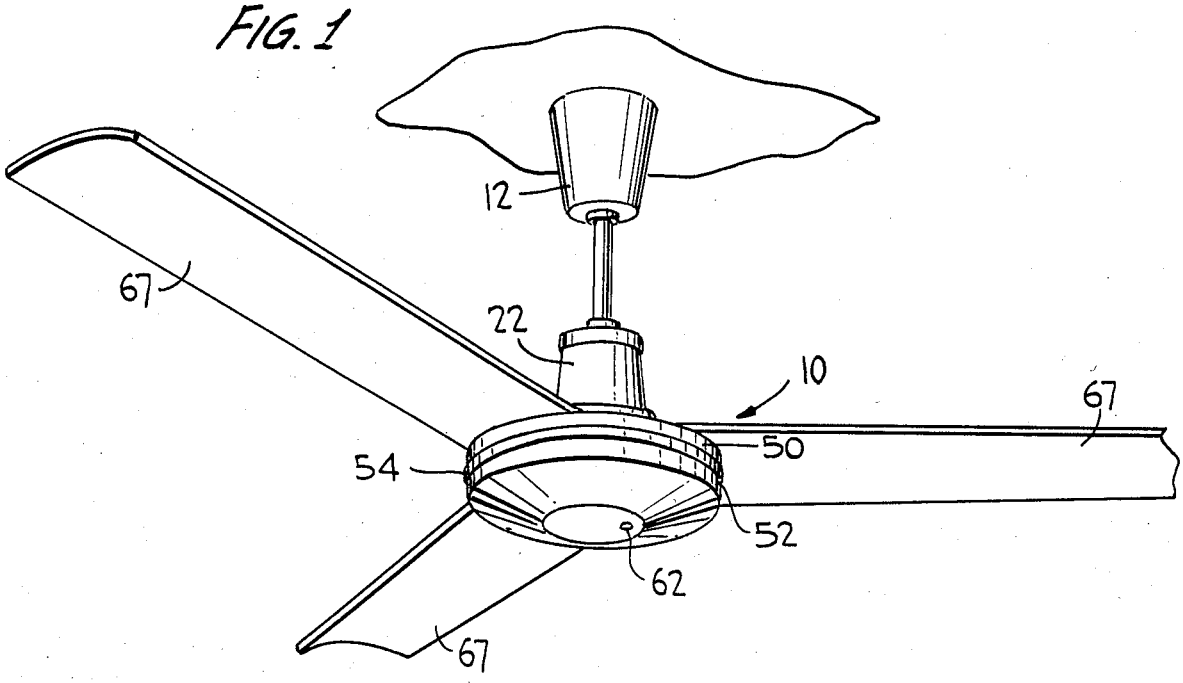
FIG. 1 is a perspective view with parts removed of a ceiling fan embodying the present invention.
Figures 2, 3:
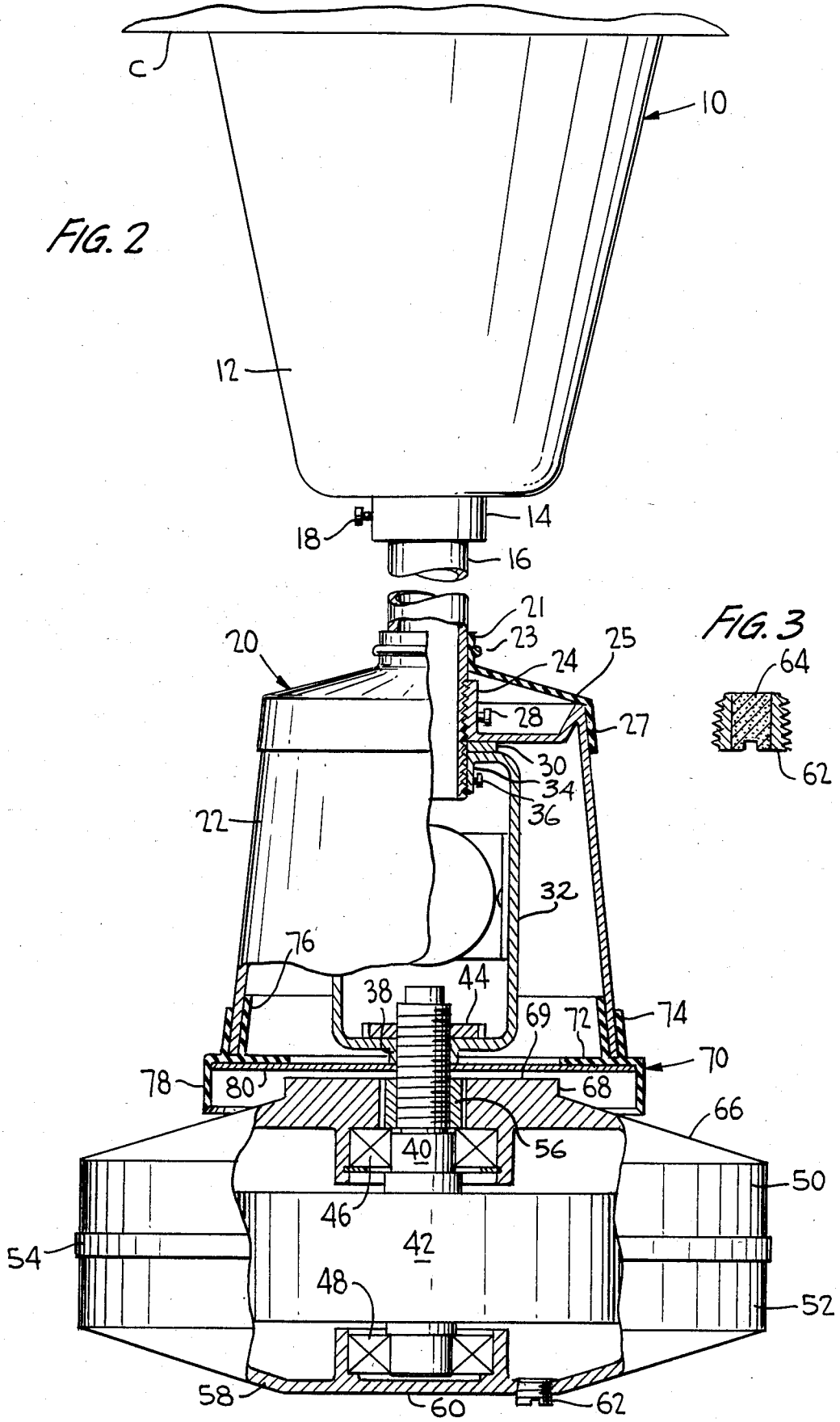
FIG. 2 is an elevational view with parts broken away and parts in section of FIG. 1 but with the fan blades removed.
FIG. 3 is an enlarged cross-sectional view of a detail shown in FIG. 2.

As is illustrated in FIG. 1 and 2, the present invention is embodied in a fan, indicated generally at 10, adapted to be suspended from an overhead support such as a ceiling structure C. The means by which the fan 10 is attached to ceiling structure may take any suitable form located within a generally inverted bell-shaped upper canopy 12 having a mounting collar 14 fixed to a hollow support rod 16 as by a set screw 18 (see FIG. 2). The particular attachment means may vary but one arrangement is shown in a fan sold by Leading Edge, Inc. under the trademark AWESOME.

A lower canopy 22 has a mounting collar 24 and is fixed to the lower portion of the hollow support rod 16 as by a set screw 28 (see FIG. 3). A hood or cover 20, made of any suitable sealing material, such as rubber, plastic, etc., includes an open neck 21 through which the rod 16 extends. The neck 21 is a tight fit on the rod 16 and is held in sealing relation therewith by an O-ring flexible band 23. The neck 21 is joined to an annular outwardly and downwardly sloping portion 25 that terminates in a downwardly extending rim 27 fitting tightly over the top of the lower canopy 22. An annular lock nut 30 tightened onto the rod 16 engages the upper surface of a solid steel yoke 32 which is rectangular in shape and which houses conventional electrical controls and wiring for the fan motor. The central portion of the yoke 32 is everted to define an annulus 34 having internal threads receiving the threaded end of the support rod 16; a cotter pin 36 extends completely through the annulus 34 and rod 16. The lower end of the yoke 32 includes a central threaded annulus 38 which receives the threaded end of a fixed shaft 40.

Conventional upper and lower bearings 46 and 48 permit mounting of an electric motor 42 in upper and lower motor housings 50 and 52 which are joined by an outer annular ring 54. A hollow cylindrical spacer 56 is press fitted onto the shaft 40 with its upper edge in abutting engagement with the contiguous edge of the yoke annulus 38.

As is viewed in FIG. 2, an outer bottom annular surface 58 tapers downwardly and inwardly to a flat bottom wall 60 from the other periphery of the lower housing 52. An opening in the bottom wall 60 is sealed by means of a threaded aluminum plug 62, the central portion of which is bored and filled with porous bronze material 64. With such an arrangement any condensation that may collect in the lower housing 52 will seep through the porous bronze material that permits little drops of the condensation to leak out one at a time.

An outer top annular surface 66 tapers upwardly and inwardly from the outer periphery of the upper housing 50 to an annular vertical wall 68. A plurality of fan blades 67 (3 are shown in FIG. 1) are secured to the annular surface 66 by any suitable fastening means, such as cap screws (not shown). The blades 67 are radially and equally spaced from each other. It should be noted that upper and lower housings 50 and 52 are generally mirror images of each other except that an annular top flat wall 69 joins the adjacent vertical wall 68 to define a ledge centered in slight spaced relation to the spacer 56. As is shown in FIG. 2, the lower portion of the ledge rests on the bearing 46. The electric motor 42 is a conventional one and, as shown in FIGS. 1 and 2, is completely enclosed within the housings 50 and 52; the central stator is fixed to the shaft 40 while the rotor is fixedly secured to the housings 50 and 52 whereby the housings 50 and 52, the fan blades 67 and the rotor of the motor 42 all rotate as a unit about the fixed shaft 40 and the fixed stator.

Figure 4:
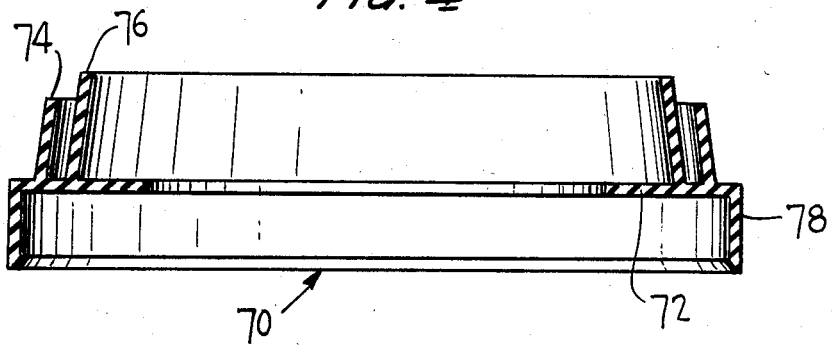
FIG. 4 is an enlarged cross-sectional view of a rubber cowling shown in FIG. 3.

The lower canopy 22 generally represents a hollow truncated cone fitting over the yoke 32. The hood 20 presents a watertight cover for the top of lower canopy 22 and a cowling, indicated generally at 70, presents a watertight cover for the bottom of lower canopy 22. The cowling 70 is made of any suitable sealing material, such as rubber, plastic, etc. and includes a flat annulus 72, through which the shaft 40 protrudes as shown in FIG. 2. Adjacent the periphery of the annulus 72, an outer sealing lip 74 having a generally hollow cylindrical configuration extends upwardly from the top surface of annulus 2 in an inwardly inclined manner (see FIG. 4). An inner sealing lip 76 also extends upwardly from the annulus 72 in spaced parallel relation to the outer sealing lip 74. The inner lip 76 extends above the outer lip 74 so as to enhance the sealing capabilities thereof. As is shown in FIG. 2, the two lips 74 and 76 are spaced from each other a distance represented by the thickness of the bottom of the lower canopy to define a U-shaped sealing arrangement which is tightly fitted onto the canopy bottom. On the outer periphery of the annulus 72, a generally hollow cylindrical skirt 78 extends perpendicularly downwardly from annulus 72 in the general opposite direction of the sealing lips 74 and 76. The bottom edge of skirt 78 is tapered and is disposed slightly above the sloping surface 66 of the upper housing 50. A metallic disc 80 having a central aperture is press fitted onto the spacer 56. The disc 80 has an upper surface in contact with the annulus 72 and is tightly fitted into the cylinder defined by the skirt 78; a lower surface of the disc 80 is slightly spaced from the ledge 69 of upper housing 50.

In the above-described construction, the motor controls in the canopy 22 and the motor 42 in the housing 50–52 are shown to be waterproofed by the hood 20, the cowling 70 with its disc 80, and the upper housing structure of the vertical wall 68 and ledge 69. Of course, the electrical connectors and the electrical wiring, which are associated with the electric controls in the lower canopy 22 and pass through the hollow support rod 16 and out of the upper canopy 12 to a suitable power source, are conventionally supplied with waterproof construction.

The above arrangement is particularly advantageous in ceiling fan installations that require waterproof construction. For example, for barns, factories, auditoriums, arenas and the like that need to be cleaned or washed down with water hoses or with overhead mounted water sprinklers, there is no present construction that would prevent water from entering those parts of a ceiling fan which contain electrical devices. Applicant's fan has a particular use in the chicken houses which in recent years have been built very large to house a great quantity of chickens grown on a chicken farm. The need for regular cleaning of a chicken house is most efficiently accomplished by a hosing down of its interior surfaces. It is also necessary for the chicken house to be provided with air circulation means to evenly distribute heated air in the winter time and cooling air in the summer time. With Applicant's fan, it is now possible to provide both of such needs without any special equipment.

Even though the fans would be mounted overhead, the hosing down operation could not prevent water from being directed into the areas of the fans. However, water would be initially diverted by the cowling skirt 78 to flow down the upper sloping surface 66 of the housing 50; any water that would pass upwardly between the skirt 78 and adjacent area of surface 66 would not normally flow uphill on the surface 66 and, even then, would be forced backward by the annular wall 68. Of course, even a small amount of water that may proceed above the annular wall 68 would have to flow inwardly across the annular ledge 69 to reach the space between the housing wall and the fixed shaft 40.

The U-shaped seal 74–76 waterproofs the lower edge of the lower canopy 22 while its upper edge is waterproofed by the O-ring 23 and rubber collar 21 forced against the hollow support rod 16 and by the hood slope 25 and peripherial flange 27 fitted against the upper portion of the lower canopy 22. The galvanized steel disc 80 which is tightly fitted against the cowling annulus 72 and against the interior of the skirt 78, has its inner opening fitted around the adjacent portion of the fixed shaft 40 so that it is in abutting relation between the upper edge of the spacer 56 and the lower edge of the yoke's annular end 38. Thus, the galvanized steel disc not only maintains the skirt in proper position relative to the upper housing surface 66, but it also inhibits any water from entering the lower part of the canopy 22.

Inasmuch as the present invention is subject to many variations, modifications and changes in detail, it is intended that all matter contained in the foregoing description or shown on the accompanying drawings shall be interpreted as illustrative and not in a limiting sense.

What is claimed is:

1. A waterproof fan comprising mounting means including a support rod (16) being adapted to support the fan in a suspended manner, an electric motor (42) adapted to rotate the fan and electric control means therefor, a housing (50–52) for said electric motor (42), a canopy (22) covering said electric controls and having a top portion (24) secured to said support rod (16) and a bottom portion disposed adjacent said housing, sealing means secured to said support rod (16) adjacent the top portion (24) of said canopy (22) to inhibit water from entering therein, and a waterproof cowling (70) for the bottom portion of said canopy (22) having a first part secured to said bottom portion to inhibit water from entering therein and having a second part projecting toward said housing (50–52) to divert water away therefrom, said waterproof cowling (70) including a generally flat annulus (72), and first part including a U-shaped sealing member (74–76) extending upwardly from said flat annulus (72) to receive the bottom portion of said canopy (22), and said second part including a skirt (78) extending from said annulus (72) in a direction generally opposite to said U-shaped sealing member (74–76) toward said housing (50–52).

2. A fan as claimed in claim 1 wherein a fixed shaft (40) is disposed centrally in said housing (50–52) and extends out of said housing (50–52) into said canopy (22) to be adapted for connection thereto, said housing (50–52) includes an outer top surface (66) tapering inwardly and upwardly to inhibit water flowing thereon, said outer top surface (66) having an annular portion adjacent said second part of said cowling (70), an annular vertical wall (68) projecting upwardly from said outer top surface (66) whereby water is precluded from flowing therepast, and a top annular flat wall (69) extending from said vertical wall (68) and terminating in slight spaced relation to said fixed shaft (40).

* * * * *